United States Patent [19]

Kristensen

[11] Patent Number: 5,012,756

[45] Date of Patent: May 7, 1991

[54] FLOATING CONSTRUCTION

[76] Inventor: Per H. Kristensen, P.O. Box 284, N-1324 Lysaker, Norway

[21] Appl. No.: 360,339

[22] Filed: Jun. 2, 1989

[51] Int. Cl.[5] ..... B63B 35/44

[52] U.S. Cl. ..... 114/265; 114/125

[58] Field of Search ..... 114/264, 265, 125, 7

[56] References Cited

U.S. PATENT DOCUMENTS

| | | | |
|---|---|---|---|
| 3,001,370 | 9/1961 | Templeton | 114/265 |
| 3,515,084 | 6/1970 | Holmes | 114/264 |
| 3,983,828 | 10/1976 | Stram | 114/265 |
| 3,986,471 | 10/1976 | Haselton | 114/265 |
| 4,169,424 | 10/1979 | Newby et al. | 114/265 |
| 4,320,993 | 3/1982 | Hunter | 114/265 |
| 4,702,648 | 10/1987 | Stageboe et al. | 114/265 |
| 4,829,928 | 5/1989 | Bergman | 114/125 |

*Primary Examiner*—David H. Brown

*Attorney, Agent, or Firm*—James E. Pittenger

[57] ABSTRACT

A floating structure (11) with completely or partially submersible pontoons that provide the buoyancy for an offshore drilling platform, with a deck that is located on columns (13) attached to the pontoons. A separate, submerged ballast unit (15) is attached to the pontoons to help stabilize the floating structure and improve its motion in waves. The ballast unit (15) is approximately the same size in the horizontal plane as the extent of the pontoons (14) and is attached to the floating structure at each corner by at least three vertical struts (16) that extend through and below the pontoons. The struts being attached so that they can be connected or removed from a locking device on the top side of the pontoons. At the upper end of the struts (16) there is an attachment head (24) which can be connected and removed from a lifting device such as a wire (25) driven by a winch mounted on the platform.

9 Claims, 2 Drawing Sheets

FLOATING CONSTRUCTION

FIELD OF THE INVENTION

The invention concerns a floating construction for use in off shore oil drilling operations.

BACKGROUND OF THE INVENTION

Various attempts have been made to stabilize the movement of floating structures, such as platforms using submerged units.

U.S. Pat. No. 3,739,737 describes how submerged "damping organs," i.e., horizontal plates, can be fitted beneath the legs of such platforms.

U.S. Pat. No. 3,986,471 describes submerged damping units that are almost as large in extent as the horizontal plan of the respective platform. This damping unit primarily consists of horizontal cellular panels with vertical sluises that, allow water to flow through from below but not from above. In addition there are two longitudinal ballast chambers that are used as pontoons during tow out to operational locations. These chambers can also be completely or partially filled with water to give the damping unit extra weight.

The main purpose of the design is to dampen the heave motion of a platform by acting as a "parachute" whenever the platform moves upwards. As the platform and the damping unit are connected by chains, the unit can only provide damping in a single direction. The complexity of the design and other factors have meant that this invention has never been realized in practice.

SUMMARY OF THE INVENTION

The main objective of the present invention is to design a floating structure with a ballast unit that firstly provides an efficient means of damping a platform's heave motion under various operational conditions. Furthermore, it must be inexpensive to construct and handle in connection with transportation to the operative location and during connection to the supporting platform.

The ballast unit according to present invention will stabilize an ordinary floating structure better than any other known unit. The invention can also be used in connection with existing offshore oil well platforms. The necessary adjustments can be made relatively easily, and in most cases the ballast unit can be raised and lowered in relation to the platform with only minimal assistance from divers.

DETAILED DESCRIPTION OF THE DRAWINGS

Figure 1:
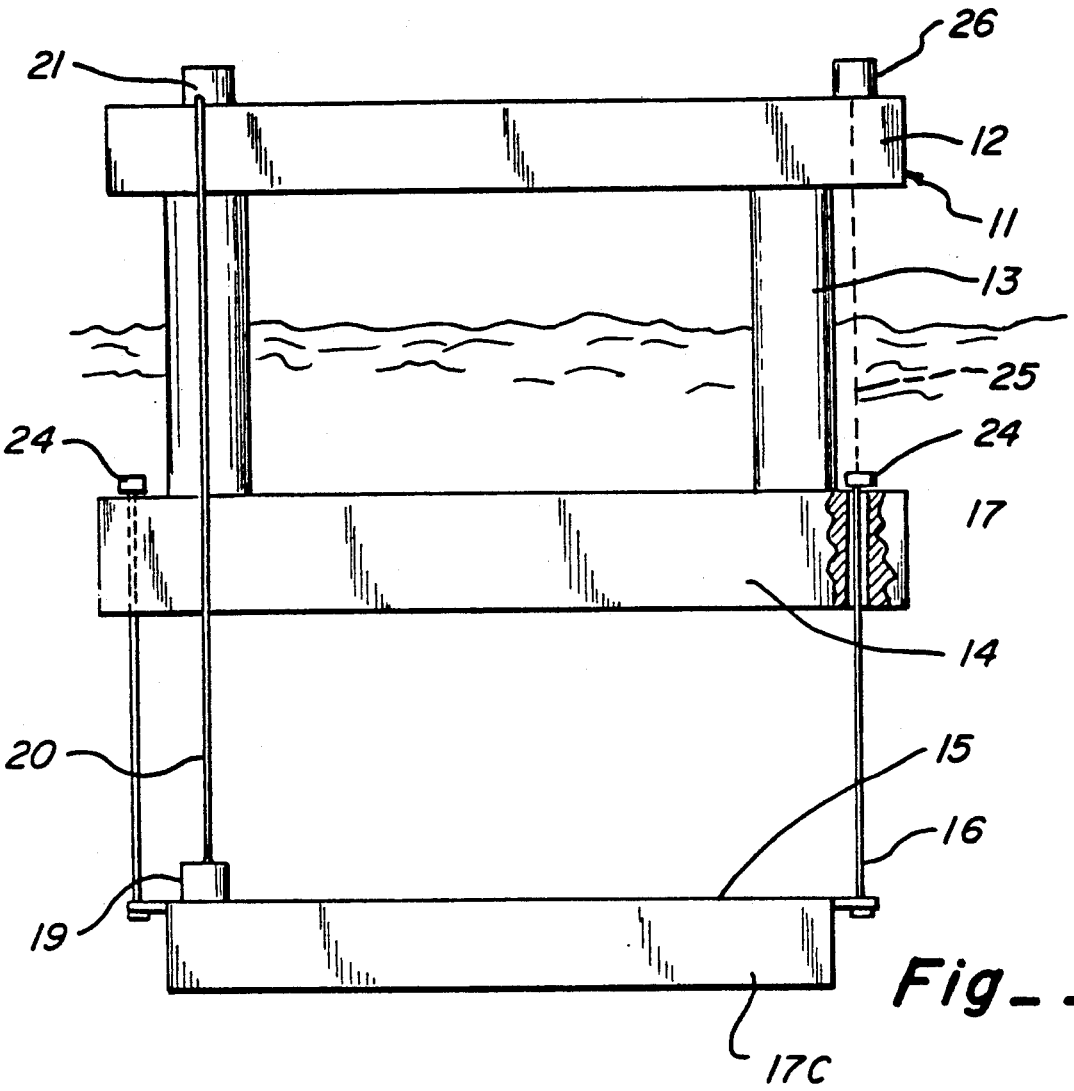
Figure 2:
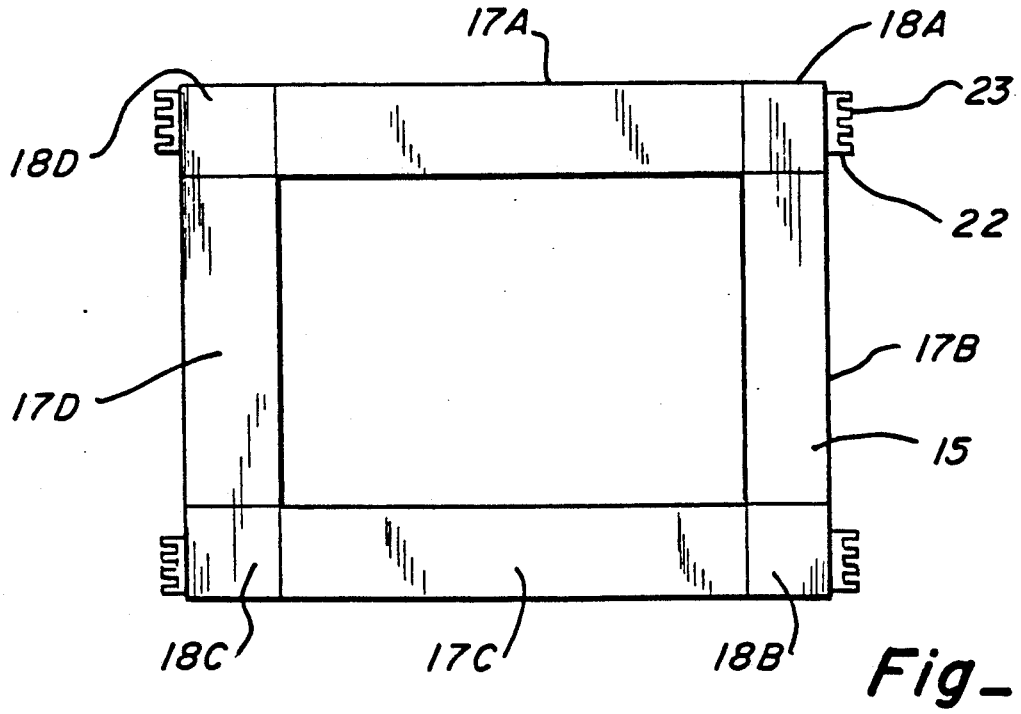
Figure 3:
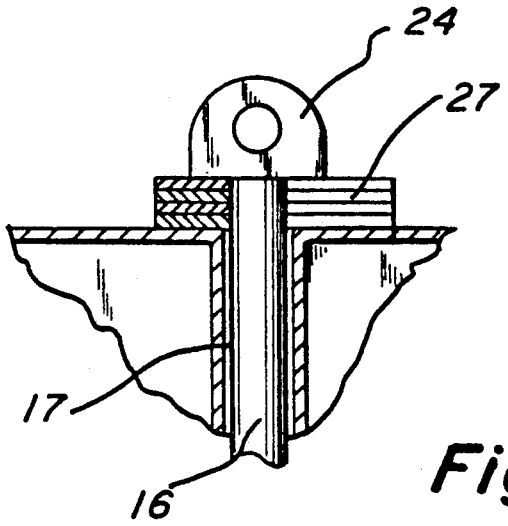
Figure 4:
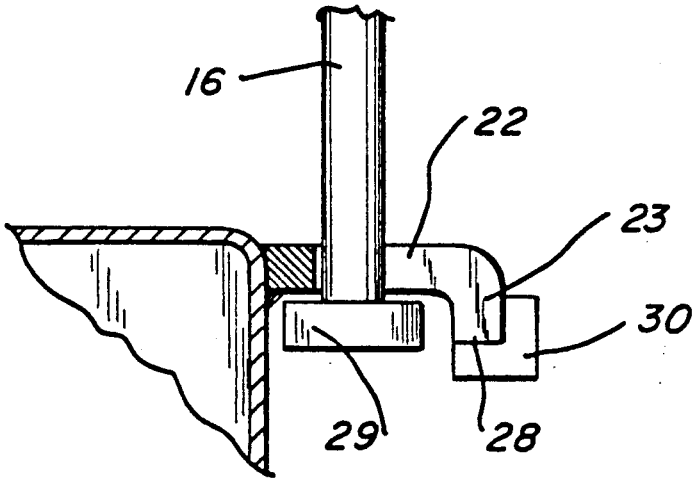

The invention will be described in more detail below with reference to an example which is sketched in the illustrations, where:

FIG. 1 shows a partial lateral elevation of a platform that is designed in accordance with the invention, FIG. 2 shows a schematic-top plan perspective of a ballast unit as used in FIG. 1, FIG. 3 shows a schematic presentation of the upper end of a support strut and its attachment, while FIG. 4 shows the equivalent for the lower end of a support strut and the means of attaching the ballast unit to the strut.

DETAILED DESCRIPTION OF THE INVENTION

In FIG. 1 there is a platform 11 with a deck structure 12, a number of support columns 13 and a pontoon structure 14. In the example this consists of two parallel hull units which are appropriately divided into chambers and fitted with ballasting equipment by known means.

Beneath the platform 11 there is a ballast unit 15, this will be described in more detail below. In the example the ballast unit 15 is shaped as a rectangular frame (FIG. 2) and is attached to the platform 11 by three tension structs 16 at each corner.

The tension structs 16 are connected by means of vertical apertures or ducts 17 through the pontoons 14 which the tension struts 16 can be lowered into from above. This will be explained in greater detail below.

FIG. 2 shows the structure of the ballast unit 15. Here there are four mainly tubular side components 17A–D and four corner pieces 18A–D fitted where the side units join. The ballast unit 15 is constructed as a hull structure with separate chambers or tanks connected by a valve system which is based on technology where the principles are already known. This valve system can use an existing design which permits the chambers in the ballast unit to be alternatively filled with seawater and oil, such as crude oil. Thus the ballest unit can also function as an intermediate storage facility for the petrochemical products extracted by the platform.

This chamber and valve system can be operatively linked to the power plant on the platform. A valve unit 19 is indicated in FIG. 1 which is connected by a hose 20 to a pump an control unit 21 on the platform deck. The control unit 21 can also include a gas compressor for pressurizing air or other gas and passing it through hose 20 for adjusting the ballast of the ballast unit 15. The practical design of this part of the structure can use known components and technology.

Retaining fittings 22 are mounted on the two opposing side edges of the ballast unit 15 at the corners. Each can have three slots 23 to retain the lower end of their respective tension struts 16.

FIG. 3 shows how a tension strut 16 can be attached at its upper end where it is supplied with a ring 24 which can be joined to a wire 25 from a winch 26 on the platform deck or at another suitable place on the platform. The tension strut 16 can be hoisted up by the wire 25 to allow the tension to be adjusted in the various struts. In the example this has been done by means of the washers or shims 27 shown in FIG. 3. Once this procedure has been completed and the various tension structs 16 have been correctly loaded, the wire 25 can be released from the point of attachment or ring 24. This can be done simply when the pontoons 14 are on the surface. When they are in their operational position, as shown in FIG. 1, this operation will require assistance from divers.

FIG. 4 shows details of the retaining fittings 22. In the example each retaining fitting 22 has an angular lug that protrudes sidewise out from the ballast unit 15. The outer edge is flanged downward at 28 so as to form a quick-connect locking edge. The lower end of a tension strut 16 with a head 29 can be fitted laterally into the respective slots 23. The retaining fitting 22 can be fitted with a locking mechanism 30 to prevent the head 29 from sliding out of the slot 23. The locking mechanism 30 can be attached and operated in any suitable manner. The locking mechanism 30 can be operated by divers once the end of the tension strut has been correctly positioned. The underside of the retaining fitting 22 will be designed in a manner that allows the head 29 to be, securely held in position by tightening the tension strut 16.

There can be three tension struts 16 at each corner of the ballast unit 15 as shown in the example. The actual number can vary according to the load conditions and the dimensions and strength of the tension struts 16.

A ballast unit in accordance with the invention can be built at an average shipyard and can be towed on the surface of the water out to its operative location. Both new and existing platforms can be equipped in accordance with the invention.

On station, the ballast unit will be submerged under the floating structure, i.e., the submerged parts of the platform, and positioned beneath them. The number of struts required are then lowered from the pontoons on the floating structure and held in position by the fittings as described above. Assistance from divers will be necessary here.

I claim:

1. A floating structure with submersible pontoons that provide the buoyancy for a platform with a deck that is located on columns that extend upwards from the pontoons, where the pontoons have the general shape of elongated hulls, and where a separate, submerged ballast unit having a plurality of ballast tanks is attached to the pontoons to help stabilize the floating structure and improve its motion in waves, characterized by the ballast unit being of approximately the same size in the horizontal plane as the extent of the pontoons, and that the ballast unit is attached to the floating structure by a plurality of vertical struts that extend through and above the pontoons, the struts being connected to the ballast unit by a means whereby they can be quickly connected or removed from the ballast unit, and where at the upper end of the struts there is an attachement means which can be attached to a lifting device, and the means for connecting the vertical struts to the ballast unit includes a plurality of quick-connect type retaining fittings attached to the sides of the ballast unit so that the vertical struts can be quickly attached or removed from the ballast unit.

2. A device in accordance with claim 1, characterized by the ballast unit consisting of a hollow structure that can be used as a storage vessel for petrochemical fluids, such as crude oil.

3. A device in accordance with claim 1, characterized by the ballast unit being shaped as a rectangular frame, where there are one or more attachement points for the vertical struts at each corner.

4. A device in accordance with claim 1, characterized by apertures in the pontoons which are designed to suitably retain the vertical struts.

5. A device in accordance with claim 1, characterized by each of the struts having an adjustment means which enables adjustment of the tension and of the final length of each strut.

6. A floating structure in accordance with claim 5, wherein the adjustment means for each strut includes one or more washers which provide a spacer between the end of the strut and the top of the pontoon to change the tension and adjust the final length of each strut.

7. A device in accordance with claim 1, characterized by the tanks in the ballast unit being connected to a gas pressurizing control means provided on the platform by hoses or pipes for the remote control of compressed gas that is to be used to ballast adjust and thereby determine the weight of the ballast unit and thereby the tension in the struts.

8. A device in accordance with claim 7, further including a lifting means mounted on the platform, characterized by the ballast unit being brought into its correct position by the lifting means, the lifting means is designed to raise and adjust the ballast unit from a position beneath the pontoons to the correct position for attaching struts, thereby bringing the ballast unit into its operative position where the struts support its weight.

9. A floating structure in accordance with claim 7, wherein the control means include means which can be used to adjust the ballast unit's mass to a given platform's natural frequency for one or more degrees of freedom, so as to trim the platform to expected environmental conditions.

* * * * *